United States Patent [19]

Fujimura et al.

[11] Patent Number: 4,663,259

[45] Date of Patent: May 5, 1987

[54] ELECTROPHOTOGRAPHIC PHOTOSENSITIVE MEMBER AND IMAGE FORMING PROCESS USING THE SAME

[75] Inventors: Naoto Fujimura, Yokohama; Kiyoshi Sakai, Chofu; Masami Okunuki, Tokyo, all of Japan

[73] Assignee: Canon Kabushiki Kaisha, Tokyo, Japan

[21] Appl. No.: 791,400

[22] Filed: Oct. 25, 1985

[30] Foreign Application Priority Data

Oct. 31, 1984 [JP] Japan ..... 59-227675

[51] Int. Cl.[4] ..... G03G 5/14

[52] U.S. Cl. ..... 430/58; 430/67

[58] Field of Search ..... 430/58, 57, 66, 67, 430/96

[56] References Cited

U.S. PATENT DOCUMENTS 4,150,987 4/1979 Anderson et al. ..... 430/58
4,232,101 11/1980 Fukuda et al. ..... 430/56
4,256,823 3/1981 Takahashi et al. ..... 430/66

*Primary Examiner*—John D. Welsh
*Attorney, Agent, or Firm*—Fitzpatrick, Cella, Harper & Scinto

[57] ABSTRACT

An electrophotographic photosensitive member comprises a conductive substrate, a charge transport layer and a charge generation layer, wherein said charge generation layer is superposed on said charge transport layer, and said charge generation layer contains particles of a fluorine-containing resin. And, an image forming process comprising the repetition of an electrophotographic process uses said electrophotographic photosensitive member.

11 Claims, 4 Drawing Figures

ELECTROPHOTOGRAPHIC PHOTOSENSITIVE MEMBER AND IMAGE FORMING PROCESS USING THE SAME

BACKGROUND OF THE INVENTION

Field of the Invention

The present invention relates to an electrophotographic photosensitive member of a laminar structure, and more particularly, to such photosensitive member having at least a charge transport layer and a charge generation layer in succession in this order on a conductive substrate, and an imaging process using such photosensitive member.

Description of the Prior Art

There is already known an electrophotographic photosensitive member in which the photosensitive layer is functionally divided into a charge generation layer and a charge transport layer, and in which certain photoconductive disazo pigments are utilizing as the charge generation material.

In general, such photosensitive member is provided with a charge generation layer and a charge transport layer superposed in this order on a conductive substrate, in which said charge transport layer contains a strongly electron-donating charge transport material to facilitate the transportation of positive charge, and such photosensitive member is negatively charged in the imaging process.

This is due to a fact that negative charge transporting materials are generally unsatisfactory in performance and are frequently unacceptable for commercial applications due to strong carcinogenicity thereof.

However, negative corona discharge results in formation of significant ozone, giving rise to an additional cost for an ozone filter in the copying machine for removing such ozone. Also periodic maintenance becomes indispensable since such ozone filter deteriorates gradually in performance in the prolonged use.

Besides the negative corona discharge tends to result in an uneven discharge, for example due to smears on the discharge wires, thus leading to uneven image density. Also the generated ozone undesirably affects the service life of the organic photoconductor.

Furthermore, the negative corona discharge is associated with deterioration of the surface of photoconductor by the generated ozone and deposition of ionic substances, generated by the discharge, onto the photoconductor, whereby the surface potential thereof is entirely or locally reduced, thus eventually causing entire or local blurs or defects in the electrophotographically reproduced image.

On the other hand, positive corona discharge generates ozone in an amount of 1/5 to 1/10 in comparison with the case of negative corona discharge, is much less associated with uneven discharge caused, for example, by the smears of the discharge wires, and is more desirable for the service life of the photosensitive member. Because of such drawbacks in the negative charging, the development of a positively chargeable photosensitive member has been desired.

A positively chargeable laminar-structure photosensitive member can be constructed, for example, by superposing a positive charge transport layer and a charge generation layer in this order on a conductive substrate.

The charge generation layer is usually made as thin as 0.1 to 0.5$\mu$, since a larger thickness leads to various drawbacks such as an enhanced photomemory or an increase in the potential in the light portion after repeated use, due to the trapping of photo-generated carriers in such thicker charge generation layer.

Also the ratio of the charge generation material to the binder is usually selected in a range from 1/1 to 3/1, since a larger content of the binder will reduce the efficiency of carrier injection from the charge generation layer to the charge transport layer, thus leading to losses in sensitivity and memory characteristics.

However, a charge generation layer, composed of dispersion of fine particles, will show a poor mechanical strength if such layer is used as the outermost layer. In a copy process for example consisting of the steps of electrostatic charging, imagewise exposure, image development, transfer of toner image onto a transfer material such as paper or plastic film, separation of the transfer material from the photosensitive member, cleaning and charge elimination before or after the cleaning, the surface of a photosensitive member utilizing such outermost charge generation layer will be gradually abraded off for example in the steps of image development, image transfer and cleaning in which said photosensitive member is brought into contact with other mechanical parts. Consequently, in the prolonged use, the photosensitive member will develop significant surface damages and a significant change in the sensitivity, or in extreme cases, the charge generation layer will be abraded off so that the photosensitivity will be entirely lost.

On the other hand, an increase in the binder content in the charge generation layer, for increasing the physical strength of the surface of photosensitive member as a countermeasure against such drawbacks, will significantly disturb the carrier transportation in the charge generation layer, leading to a lowered sensitivity, an increased photo-memory and an increased light portion potential after prolonged use.

The conventional charge generation layer is mechanically not strong enough as the surface layer and is practically unsatisfactory for use in a copying machine or a printer because of poor abrasion resistance. The abrasion is caused by various reasons but mainly by surface cleaning, particularly cleaning with a blade.

The surface deterioration in the prolonged use is initially caused by scars on the photosensitive member, and this is followed by adhesion of toner particles and deposition of talc or other substances contained in the dust coming from the transfer sheet. These deposited substances may be decomposed for example by corona discharge, thus reducing the surface resistance, particularly when moisture is absorbed in the surface, and eventually resulting in so-called image flow. In extreme case a loss in the sensitivity may result from the gradual abrasion of the surface layer.

SUMMARY OF THE INVENTION

In consideration of the foregoing, an object of the present invention is to provide an electrophotographic photosensitive layer provided with a charge generation layer having excellent durability in use.

Another object of the present invention is to provide a photosensitive member which is free from loss in sensitivity or photo-memory even after prolonged use.

Still another object of the present invention is to provide an electrophotographic imaging process utilizing rubber cleaning means, capable of providing sharp images over a prolonged period.

The foregoing objects can be achieved, according to the present invention, by a photosensitive member containing particles of a fluorine-containing resin in the charge generation layer, thereby significantly reducing the abrasion of said layer and the change in sensitivity, in prolonged continuous use.

According to an aspect of the present invention, there is provided an electrophotographic photosensitive member comprising a conductive substrate, a charge transport layer and a charge generation layer, wherein said charge generation layer is superposed on said charge transport layer, and said charge generation layer contains particles of a fluorine-containing resin.

According to another aspect of the present invention, there is provided an image forming process comprising the repetition of an electrophotographic process which comprises a step of forming an electrostatic latent image on an electrophotographic photosensitive member comprising a conductive substrate, a charge transport layer and a charge generation layer in which said charge generation layer is superposed on said charge transport layer and contains particles of a fluorine-containing resin, a step of developing said latent image, a step of transferring thus obtained toner image and a step of cleaning the remaining toner with cleaning means having a rubber hardness not less than 65 and maintained at a contact angle of at least 25°.

DESCRIPTION OF THE PREFERRED EMBODIMENTS

Figure 1:
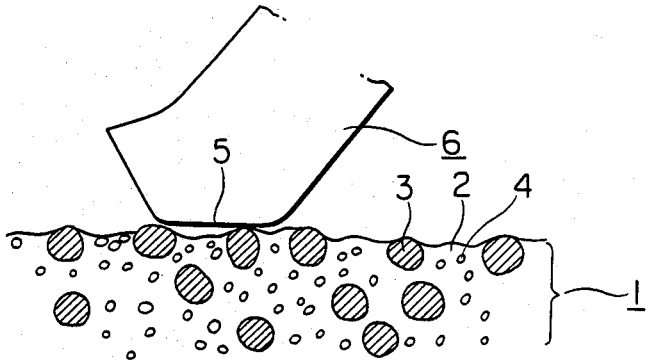
FIG. 1 is a schematic view for explanation of contact state between a cleaning blade and a charge generation layer in which particles of fluorine-containing material and those of charge generation material are dispersed.

The particles of fluorine-containing resin to be employed in the present invention function as a solid lubricant. They can be uniformly dispersed in the charge generation layer so that the lubricating performance is not lowered during prolonged use, and a low friction coefficient is provided.

In contrast to the aforementioned conventional art in which a charge transport layer is provided at the surface and is charged with negative corona discharge, the present invention, in which a charge generation layer of an improved durability is formed at the surface and is charged with positive corona involving little ozone formation, not only provides a positively chargeable photosensitive member of characteristics comparable to those in the conventional art but also drastically improves the durability of such photosensitive member.

Also the photosensitive member of the present invention can be used in a process involving a grinding, or abrading step.

The abrasion may be achieved either by an abrading device such as a magnet brush, a sand paper or a sponge roller positioned around the photosensitive member, or by an abrasive material incorporated in the toner, or by supplying an abrasive material through suitable means onto the photosensitive member.

Examples of abrasive material that can be incorporated in the toner are $SiO_2$, $Si(OH)_2.nH_2O$, diatomaceous earth, clay, caolin, chromium oxide, $Al(OH)_3.nH_2O$, SiC (carborundum), $B_4C$, $Al_2O_3$, $CeO_2$, $Al_2(SO_4)(OH)_4$, iron oxide, $Si_3N_4$, $MgCO_3$, $CaCO_3$, barium oxide, stronthium titanate, $TiO_2$, $BaSO_4$ and ZnO, and the preferred particle size is in a range from 0.05 to 10μ.

In this manner it is rendered possible to remove ionic deposition such as $NO_x$ or $NH_4Cl$, slight toner fusion, fingerprints, oil, fat etc. from the surface of the photosensitive member, thereby further improving the durability thereof.

The charge generation material to be employed in the present invention is composed principally of an organic compound, but it may also be composed of an inorganic material such as amorphous selenium, amorphous silicon, CdS or Se-Te.

Said charge generation material is generally a pigment, but a dye soluble in solvent can also be utilized in a state of granules by the selection of a suitable solvent.

Examples of the charge generation material to be employed in the present invention are phthalocyanine pigments, anthanthrone pigments, dibenzpyrene pigments, pyranthrone pigments, trisazo pigments, disazo pigments, azo pigments, indigo pigments, quinacridone pigments, asymmetric quinocyanine, quinocyanine, azulenium salts, pyrylium dyes, thiapyrylium dyes, cyanine dyes, xanthene dyes, quinonimine dyes, tripheylmethane dyes, styryl dyes, selenium, selenium-tellurium, cadmium sulfide and amorphous silicon. In case of a charge generation material composed of pigment particles, the preferred particle size is in a range from 0.03 to 0.5μ.

Examples of the binder to be employed in said charge generation layer are phenoxy resins, polyacrylamide, polyvinylbutyral, polyarylate, polysulfon, polyamide, acrylic resins, acrylonitrile resins, methacrylic resins, polyvinyl chloride resins, polyvinyl acetate resins, phenolic resins, epoxy resins, polyester, alkyd resins, polycarbonate, polyurethane, and copolymers containing at least two of the monomer unit constituting the foregoing resins, such as styrene-butadiene copolymers, styrene-acrylonitrile copolymers, styrene-maleic acid copolymers etc.

Also an organic photoconductive polymer, such as poly-N-vinylcarbazole, polyvinylanthracene or polyvinylpyrene is usable for this purpose and is effective for improving the characteristics such as sensitivity and memory of the charge generation layer.

The thickness of the charge generation layer is selected within a range from 0.01 to 15μ, preferably from 0.05 to 5μ, and the weight ratio of the charge generation material to the binder is selected within a range from 10:1 to 1:10, preferably from 3:1 to 1:3.

Examples of the fluorine-containing resin particles to be incorporated in the charge generation layer of the present invention are granules of tetrafluoroethylene resins, tetrafluoroethylene-hexafluoropropylene copolymer resins, tetrafluoroethyleneperfluoroalkoxyethylene copolymer resins, trifluorochloroethylene resins, tetrafluoroethylene-ethylene copolymer resins or fluorinated vinylidene resins, and granules of resins containing fluorine atoms in the side chains.

Such particles of fluorine-containing resin may be utilized in a state of emulsion or suspension, but is preferably utilized through dispersing technology.

The dispersion is achieved, for example, by mixing a dispersion of the aforementioned fluorine-containing material in a suitable solvent such as alcohol, ester, ketone, aromatic solvent or water, with a dispersion of the charge generation material, or dispersing said fluorine-containing material together with a surface active agent required for dispersion, or dispersing said fluorine-containing material together with the charge generation material and the binder.

The particle size of the fluorine-containing resin particles to be employed in the present invention is preferably not smaller than 0.1μ, and in consideration of the granularity of the obtained image, the particle size is preferably not larger than 5μ, more preferably not larger than 3μ.

For improving the durability of service life of the photosensitive member through the addition of particles of the fluorine-containing resin, the particle size thereof is preferably larger than that of the pigment particles constituting the charge generation material. In this manner the fluorine-containing resin particles have a higher probability of being present at the surface of the charge generation layer, and the charge-generation resin particles are protected between the fluorine-containing resin particles. FIG. 1 schematically shows such state, wherein the charge generation layer 1 contains particles 3 of a fluorine-containing resin and pigment particles 4, both dispersed in a binder 2, and a contact end portion 5 of a cleaning blade 6 is mainly in contact with the fluorine-containing resin particles. Consequently the friction between the cleaning blade and the charge generation layer is principally governed by the friction with the fluorine-containing resin particles and is therefore reduced to a significantly smaller value, which is extremely favorable for improving the durability of the photosensitive member.

The particle size of the fluorine-containing resin particles or the pigment particles is defined by the average of longer axis of the particle observed under a transmission electron microscope. The particle size after the formation of the charge generation layer can be measured dissolving the charge generation layer in a suitable solvent and observing the solid content under a transmission electron microscope.

The ratio of the solid lubricant in the charge generation layer is selected preferably in a range from 0.1 to 40 wt. %, more preferably from 5 to 25 wt. %.

The electrophotographic photosensitive member of the present invention has an improved surface smoothness, thus allowing efficient removal, with a cleaning blade, of toner deposited in the repeated electrophotographic cycles or paper dust resulting from the transfer sheet. However the cleaning blade 9 tends to move, from a normal contact state in which the edge of the cleaning blade is in contact with the surface of the photosensitive member as shown in FIG. 2, into an abnormal contact state in which the side surface of the cleaning blade is in contact with the surface of the photosensitive member as shown in FIG. 3, which may result in an unsatisfactory cleaning or an image flow phenomenon to be explained in the following.

Figure 2:
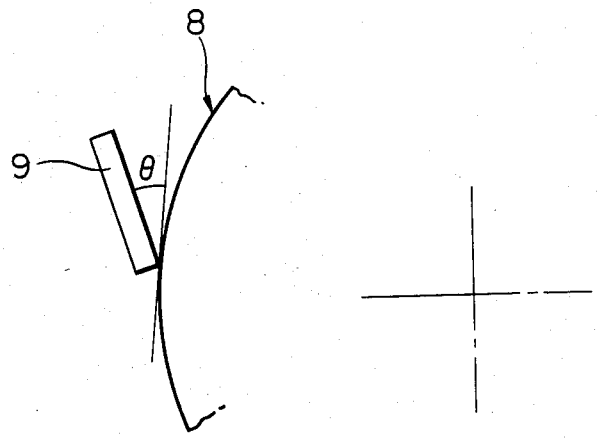
FIG. 2 is a schematic view of normal contact state of a cleaning blade with the surface of photosensitive member.
Figure 3:
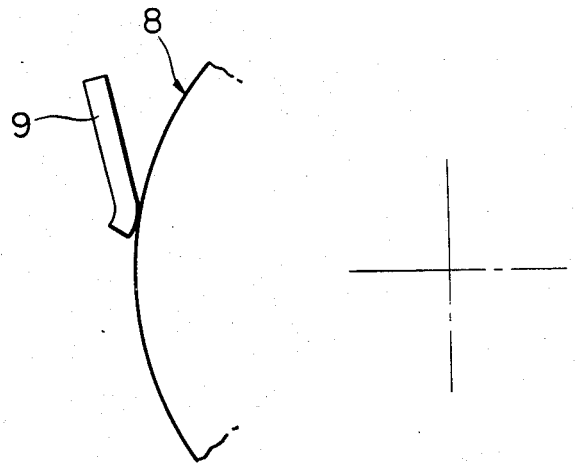
FIG. 3 is a schematic view of abnormal contact state of a cleaning blade with the surface of a photosensitive member.

Said image flow phenomenon, which may be caused by the paper dust, can be prevented when the cleaning blade 9 is in the normal contact state as shown in FIG. 2 and is capable of efficiently removing the paper dust. However, such image flow is also caused by the deterioration of the surface of the photosensitive member by the corona discharge, when the imaging process is repeated, in the positive charging as well as in the negative charging.

More specifically, ozone and ions generated in the charging step in the electrophotographic process create certain polar groups on the photosensitive member, and said phenomenon is caused by a fact that said polar groups electrically attract or repel the charge of electrostatic latent image formed in the exposure step following said charging step. Thus, the cleaning blade 9 also has a function of eliminating such polar groups from the surface 8 of the photosensitive member. In order to fully achieve the expected effects, the cleaning blade 9 has to be maintained in the normal contact state, as shown in FIG. 2, throughout the electrophotographic imaging process. In order to avoid the abnormal contact state shown in FIG. 3, in case of the photosensitive member provided, at the surface thereof, with a charge generation layer containing the aforementioned fluorine-containing resin particles according to the present invention, it has been found effective to form said cleaning blade with a rubber-like material having a rubber hardness of at least 65 and to maintain said cleaning blade at a contact angle $\theta$ of at least 25°, with the photosensitive member. In case the photosensitive member is shaped as a drum, said contact angle is defined by an angle to a tangential line to said drum.

The hardness used herein is measured according to a method described in JIS (Japanese Industrial Standard) K-6301 using an instrument of type JIS-A, Model Teclock GS706 manufactured by Teclock Co.

In the present invention, the use of a grinding or abrading step in the imaging process is effective for preventing the formation of a blurred image, which is caused by said image flow phenomenon and results from the surfacial deterioration of the photosensitive member by the corona discharge. For preventing such blurred image it has been found necessary to prepare the aforementioned cleaning blade with a hardness not less than 75 and to maintain such cleaning blade at a contact angle at least equal to 35°, but such conditions for the cleaning blade are not desirable in consideration of the manufacturing costs. On the other hand, in the presence of said abrading step, the blurred image resulting from the surface deterioration of the photosensitive member can be prevented even if the cleaning blade is prepared with a hardless lower than 75 and is maintained at a contact angle less than 35°. Consequently, according to the present invention, said hardness can be selected in a range from 65 to 75, and said contact angle can be 25°-35°.

Figure 4:
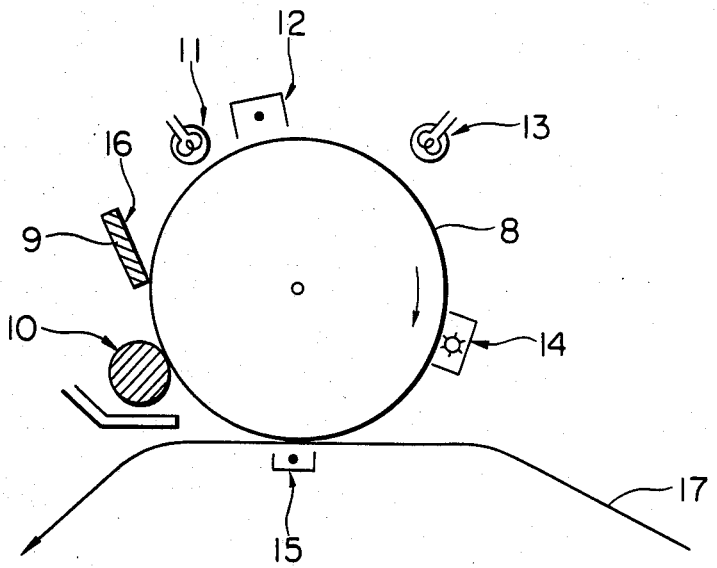
FIG. 4 is a schematic view of an example of image forming process of the present invention.

FIG. 4 shows an electrophotographic imaging process comprising a pre-exposure step 11, a charging step 12 and an imagewise exposure step 13 constituting a latent image forming process, a developing step 14, an image transfer step 15 and a cleaning step 16. Said abrading step 10 is preferably conducted between said image transfer step 16 and said cleaning step 16. In said abrading step 10 there is conveniently employed roller means, preferably elastic roller means. There is also shown a transfer sheet 17.

Said elastic roller can be composed, for example, of rubber-like material or sponge composed of silicone resin, polyurethane resin, polyester resin, acrylic resin, styrenic resin, polyethylene resin, fluorinated resin, butadiene rubber, isoprene or chlorinated rubber. It may also have a double-layered structure, in which the internal layer is composed of an elastic material and the external layer is composed of a resin layer. Said elastic roller is maintained in contact with the photosensitive member, and is rotated either with a peripheral speed larger than that of the photosensitive member or in a peripheral direction opposite to that of said photosensitive member, thereby abrading the surface thereof.

The charge transport layer is in electrical contact with said charge generation layer, and has a function, in the presence of an electric field, of receiving charge carriers injected from said charge generation layer and transporting said charge carriers to the surface of the conductive substrate or to the surface of an underlayer provided between said conductive substrate and the charge transport layer. Said charge transport layer is composed of a positive charge transporting material.

Examples of the organic charge transporting materials to be employed in the present invention are: N-ethylcarbazole, N-methyl-N-phenylhydrazino-3-methylidene-9-ethylcarbazole, N,N-diphenylhydrazino-3-methylidene-10-ethylphenothiazine; hydrazones such as p-diethylaminobenzaldehyde-N,N-diphenylhydrazone, p-pyrrolidinobenzaldehyde-N,N-diphenylhydrazone or p-diethylbenzaldehyde-3-methylbenzthiazolinone-2-hydrazone; 2,5-bis(p-diethylaminophenyl)-1,3,4-oxadiazole; pyrrazolines such as 1-[quinolyl(2)]-3-(p-diethylaminostyryl)-5-(p-diethylaminophenyl)pyrrazoline, 1-[6-methoxypyridyl-(2)]-3-(p-diethylaminostyryl)-5-(p-diethylaminophenyl)pyrrazoline, 1-[lepidyl(2)]-3-(p-diethylaminostyryl)-5-(p-diethylaminophenyl)pyrrazoline, 1-[pyridyl(2)]-3-(α-methyl-p-diethylaminostyryl)-5-(p-diethylaminophenyl)pyrrazoline, or spiropyrrazoline; oxazoles such as 2-(p-diethylaminostyryl)-6-diethylaminobenzoxazole or 2-(p-diethylaminophenyl)-4-(p-dimethylaminophenyl)-5-(2-chlorophenyl-)oxazole; thiazoles such as 2-(p-diethylaminostyryl)-6-diethylaminobenzothiazole; triarylmethanes such as bis(4-diethylamino-2-methylphenyl)phenylmethane; polyarylalkanes such as 1,1-bis(4-N,N-diethylamino-2-methylphenyl)heptane or 1,1,2,2-tetrakis(4-N,N-dimethylamino-2-methylphenyl)ethane; triphenylamine, poly-N-vinylcarbazole, polyvinylpyrene, polyvinylanthracene, polyvinylacrydine, poly-9-vinylphenylanthracene, pyrene-formaldehyde resin, ethylcarbazole-formaldehyde resin and mixtures thereof.

Examples of the binder to be employed in such charge transport layer are: polyacrylamide, polyarylate resin, polyamide resins, acrylonitrile resins, methacrylic resins, vinyl acetate resins, epoxy resins, polyesters, alkyd resins, polycarbonates and copolymers of at least two of the monomers constituting the above-mentioned resins such as styrene-butadiene copolymers, styrene-acrylonitrile copolymers, or styrene-maleic acid copolymers. Also there can be employed an organic photoconductive polymer such as poly-N-vinylcarbazole or polyvinylanthracene. The thickness of the charge transport layer is selected in a range from 5 to 50μ, preferably from 8 to 20μ, and the weight ratio of the charge generation material to the binder is selected in a range from 5:1 to 1:5, preferably from 3:1 to 1:3.

The photosensitive layer comprising the above-explained laminate structure of a charge generation layer and a charge transport layer, is provided on a substrate having a conductive layer. Said substrate having a conductive layer may be a substrate which itself is conductive such as aluminum, copper, vanadium, chromium or indium; a plastic substrate such as polyethylene, polypropylene, polyvinyl chloride, polyethylene terephthalate, acrylic resin, polyethylene fluoride and the like, provided with a vacuum vapor deposited layer of aluminum, an aluminum alloy, indium oxide, tin oxide or an indium oxide-tin oxide alloy; a plastic substrate coated with particles of a conductive material such as carbon black, silver and the like mixed with a suitable binder; a plastic or paper substrate impregnated with conductive particles; or a plastic substrate containing conductive polymer.

Between the conductive layer and the photosensitive layer, there may be provided an underlayer having the functions of barrier and adhesion. Said underlayer can be composed of casein, polyvinyl alcohol, nitrocellulose, ethylene-acrylic acid copolymer, or polyamides such as nylon-6, nylon-66, nylon-610, copolymerized nylon, alkoxymethylated nylon, and the like, polyurethane, gelatin, aluminum oxide or the like. The thickness of said underlayer is selected not exceeding 5μ, preferably in a range from 0.5 to 3μ. For achieving said barrier function, the resistivity of said layer is preferably not less than $10^7$ Ω cm.

The electrophotographic photosensitive member of the present invention is applicable not only in electrophotographic copying machines but also in other electrophotographic fields such as laser beam printers or cathode ray tube printers.

EXAMPLE 1

An aluminum cylinder of a diameter of 60 mm, a length of 250 mm and a thickness of 1.0 mm was dip coated with aqueous solution of ammonia, containing 11.2 grs. of casein, 1 gr. of 28% ammonia solution and 222 ml of water, to obtain a thickness of 1.0μ after drying, thus obtaining an underlayer.

Then 5 grs. of a hydrazone compound of the following formula:

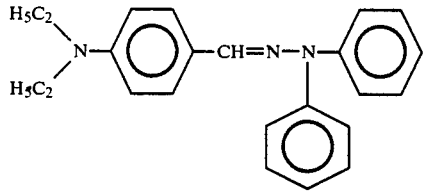

and 5 grs. of polymethyl methacrylate, having a number-average molecular weight of 100,000, were dissolved in 70 ml of benzene, and the obtained solution was dip coated on said underlayer so as to obtain a thickness of 12μ after drying. A charge transport layer was prepared in this manner.

Subsequently 10 parts of polymethyl methacrylate, having a number-average molecular weight of 100,000 were dissolved in 800 parts of chlorobenzene, and 5 parts of a tetrafluoroethylene resin (Lubron L-2 manufactured by Daikin Kogyo Co., Ltd.) and 1 part of a disazo pigment of the following formula:

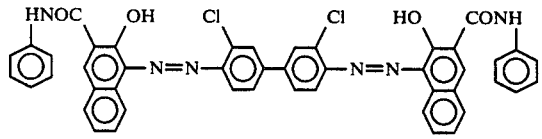

were dispersed, for 10 hours in a sand mill, in thus obtained solution. The resulting dispersion was dip coated on the above-mentioned charge transport layer and dried to obtain a charge generation layer of a thickness of 5μ, thus completing an electrophotographic photosensitive member.

The particle size of Lubron L-2 was 0.1μ, while that of the charge generation material was 0.2μ. (Sample A).

Then, the above-described procedure was reproduced up to the preparation of the charge transport layer, and a charge generation layer was prepared in the following manner.

5 parts of polymethyl methacrylate, having a number-average molecular weight of 100,000, was dissolved in 400 parts of chlorobenzene, and 5 parts of a tetrafluoroethylene resin (Lubron L-2 manufactured by Daikin Kogyo Co., ltd.) were dispersed into thus obtained solution for 5 hours in a sand mill.

Subsequently 5 parts of same polymethyl methacrylate were dissolved in 400 parts of chlorobenzene, and 1 part of the same charge generation material as in the sample A was mixed with thus obtained solution and dispersed for 10 hours in a sand mill. The obtained dispersion was mixed with the above-mentioned dispersion and spray coated and dried so as to obtain a thickness of 5μ after drying, thus obtaining an electrophotographic photosensitive member. The particle size of Lubron L-2 was 0.3μ, while that of the charge generation material was 0.2μ (Sample B).

Then the foregoing procedure was reproduced to obtain another photosensitive member, except that Lubron L-2 was dispersed for 3 hours while the charge generation material was dispersed for 10 hours. The particle size of Lubron L-2 was 0.8μ, while that of the charge generation material was 0.2μ (Sample C).

Again the foregoing procedure was reproduced to obtain still another photosensitive member, except that Lubron L-2 was dispersed for 1 hour while the charge generation material was dispersed for 10 hours. The particle size of Lubron L-2 was 3μ while that of the charge generation material was 0.2μ (Sample D).

COMPARATIVE EXAMPLE 1

A photosensitive member was prepared according to the same procedure as in the Example 1, except that the tetrafluoroethylene resin was not employed in the charge generation layer.

The electrophotographic photosensitive members prepared in this manner were evaluated in Canon Minicopier PC-20, which was converted to utilize a positive primary charging, a positive transfer charging and negative toner. The photosensitive members prepared according to the present invention all showed a satisfactory positive chargeability, a satisfactory sensitivity under positive charging and an excellent durability.

| Sample | Sensitivity (lux · sec) | Durability | (abrasion after 50,000 copies) |
|---|---|---|---|
| A | 3.1 | Scars developed after 7,000 to 8,000 copies. Fogged image due to sensitivity loss and toner adhesion in non-image areas were observed after 20,000 copies. | 4μ |
| B | 2.6 | Slight scars developed after 40,000 copies, and toner adhesion in non-image areas was observed after 50,000 copies. | 2.3μ |
| C | 2.4 | No abnormality observed after 50,000 copies. | 0.8μ |
| D | 2.3 | No abnormality observed after 50,000 copies. | 0.7μ |
| Comparative Example | 3.3 | Scars developed after 3,500 copies. Fogged image due to sensitivity loss and toner adhesion in non-image areas were observed after 5,000 copies. | 5μ (after 10,000 copies) |

EXAMPLE 2

A charge transport layer was prepared according to the same procedure as in the Example 1. Then a photosensitive member was completed in the same procedure as in the Example 1, except that tetrafluoroethylene resin employed in the charge transport layer and the charge generation layer of the Example 1 was replaced by a fluorinated vinylidene resin (Trade name: Kinar 731 manufactured by Penwalt Co.).

| | Charge generation material Kynar | | | |
|---|---|---|---|---|
| | Dispersing time | Particle size | Dispersing time | Particle size |
| Sample A | 5 hrs. | 0.35 | 5 hrs. | 0.2 |
| Sample B | 5 | 0.35 | 3 | 0.4 |
| Sample C | 5 | 0.35 | 1 | 1.1 |
| Sample D | 5 | 0.35 | 0.5 | 2 |

COMPARATIVE EXAMPLE 2

A photosensitive member was prepared by reproducing the procedure of the Example 2, except that the fluorinated vinylidene resin was not employed in the charge generation layer.

The electrophotographic photosensitive members thus prepared were evaluated in Canon Minicopier PC-20 which was converted to utilize a positive primary charging, a positive transfer charging and negative toner. The photosensitive members prepared according to the present invention all showed a satisfactory positive chargeability, a satisfactory sensitivity under positive charging and an excellent durability.

| Sample | Sensitivity (lux · sec) | Durability | (abrasion after 50,000 copies) |
|---|---|---|---|
| A | 3.3 | Scars developed after 6,000 copies. Fogged image due to sensitivity loss and toner adhesion in the non-image area were observed after 13,000 copies. | 5μ |
| B | 2.7 | Slight scars developed after 50,000 copies, but no fogged image was observed. | 1.4μ |
| C | 2.6 | No abnormality observed after 50,000 copies. | 1.0μ |
| D | 2.4 | No abnormality observed after 50,000 copies. | 0.9μ |
| Comparative Example | 3.6 | Scars developed after 3,500 copies Fogged image due to sensitivity loss and toner adhesion in the non-image area were observed after 5,000 copies. | 5μ (after 10,000 copies) |

EXAMPLE 3

An electrophotographic photosensitive member was prepared by dip coating an aluminum cylinder of a diameter of 30 mm, with the same coating liquids as for the Sample B in the Example 1, except that the binder resin employed in the charge generation layer was replaced by bisphenol-Z type polycarbonate resin with a number-average molecular weight of 25,000.

The obtained photosensitive drum was mounted in a copying machine, Canon PC-30, converted to utilize a positive primary charging, a positive transfer charging and negative toner, and subjected to the comparison of surface potential before and after a continuous running test of 10,000 copies, with an initial dark potential of +700 V, an initial light potential of +100 V and with negatively charged toner.

Along the photosensitive drum in the test machine, there were provided a positive corona charger, an exposure unit, a developing unit, a positive transfer corona charger, a cleaning blade and a pre-exposure lamp.

The result of said comparison is as follows:

| | Initial | After 10,000 copies |
|---|---|---|
| Light potential | +700 V | +710 V |
| Dark potential | +100 V | +125 V |

In this manner the change in sensitivity was small after the continuous running test, and the image was satisfactory even after 10,000 copies, without blurs due to deterioration by ozone, image defects due to surface abrasion or uneven discharge due to smears on the corona wires.

EXAMPLE 4

100 parts by weight of p-diethylaminobenzaldehyde-α-naphthylphenylhydrazone as the charge transport material and 100 parts by weight of an acrylstyrene resin (MS-200 manufactured by Shin-Nittetsu Kagaku Co., Ltd.) as the binder were dissolved in monochlorobenzene to obtain a coating liquid for the charge transport layer with a viscosity of 120 cp.

An aluminum cylinder of a diameter of 60 mm, a length of 350 mm and a thickness of 0.8 mm was dip coated with said coating liquid and dried for 80 minutes at 105° C. to obtain a thickness of 20μ after drying.

1 part of a disazo pigment of the following formula:

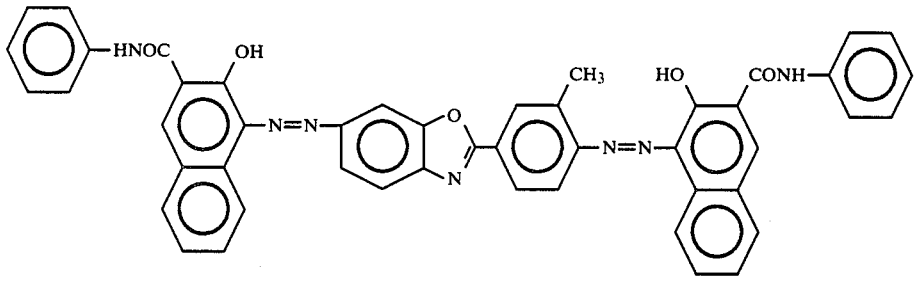

was added to a solution of 5 parts of bisphenol-Z type polycarbonate resin, having a number-average molecular weight of 12,000, dissolved in 30 parts of cyclohexanone and dispersed therein for 10 hours in a sand mill.

Separately 3 parts of teflon resin (Lubron L-5 manufactured by Daikin Kogyo Co., ltd.) was added to a solution of 5 parts of said polycarbonate resin dissolved in 30 parts of cyclohexanone and dispersed therein for 5 hours in a sand mill.

These two dispersions were mixed to obtain a coating liquid for the charge generation layer.

Said coating liquid was spray coated on said charge transport layer and dried for 60 minutes at 110° C. to obtain a dry thickness of 6μ. Thereby, the charge generation layer was formed. In this manner a photosensitive drum was completed.

The particle size of the charge generation material was 0.23μ, while that of teflon particles was 0.40μ.

COMPARATIVE EXAMPLE 3

A photosensitive member was prepared as in the Example 4, but without the use of said teflon resin.

The above-mentioned two photosensitive drums were subjected to a continuous running test in copying machines, Canon NP-150Z, which was converted to utilize a positive primary charging, a positive transfer charging and negative toner. The copying machines were equipped with cleaning blades of the following conditions as abrading means for the surface of the photosensitive member, with or without a roller of silicone resin sponge immediately in front of said cleaning blade:

| | Blade hardness | Contact angle | Silicone sponge roller |
|---|---|---|---|
| A | 60 | 20° | none |
| B | 65 | 25° | none |
| C | 65 | 25° | present |
| D | 70 | 30° | none |
| E | 70 | 30° | present |
| F | 75 | 35° | none |

The results of said test are summarized in the following table, in which figures indicate the maximum number of copies, judged in consideration of scars and image flow.

| | Example 4 | Comparative Example 3 |
|---|---|---|
| A | 5,000 (slight image flow) | 1,000 or less (image flow) |
| B | 15,000 (image flow) | 1,000 or less (scars and image flow) |
| C | 50,000 (no image flow) | 1,000 or less (scars) |
| D | 50,000 (ibid.) | 1,000 or less (ibid.) |
| E | 100,000 (ibid.) | 1,000 or less (ibid.) |
| F | 100,000 (ibid.) | 1,000 or less (ibid.) |

In this manner the photosensitive member and the conditions for cleaning blade or the abrasion with the elastic roller, according to the present invention, are demonstrated to be effective.

What is claimed is:

1. An electrophotographic photosensitive member comprising, in sequence, a conductive substrate, a charge transport layer and a charge generation layer, said charge generation layer comprises pigment particles as charge generation material and particles of a fluorine-containing resin, wherein the particle size of said fluorine-containing resin is larger than that of said pigment particles.

2. An electrophotographic photosensitive member according to claim 1, wherein said charge generation layer contains the particles of said fluorine-containing resin therein in an amount of 0.1 to 40% by weight.

3. An electrophotographic photosensitive member according to claim 1, wherein said charge generation layer contains the particles of said fluorine-containing resin therein in an amount of 5 to 25% by weight.

4. An electrophotographic photosensitive member according to claim 1, wherein the particle size of said pigment is in a range from 0.03 to 0.5μ.

5. An image forming process comprising repeating an electrophotographic process which comprises (a) forming an electrostatic latent image on an electrophotographic photosensitive member comprising, in sequence, a conductive substrate, a charge transport layer and a charge generation layer in which said charge generation layer comprises pigment particles as charge generation material and particles of a fluorine-containing resin, wherein the particle size of said fluorine-containing resin is larger than that of said pigment particles, (b) developing said latent image to form a toner image, (c) transferring the toner image and (d) cleaning any remaining toner with cleaning means having a rubber hardness not less than 65 and maintained at a contact angle of at least 25°.

6. An image forming process according to claim 5, wherein a step for abrading the electrophotographic photosensitive member is conducted between said image transfer step and said cleaning step.

7. An image forming process according to claim 6, wherein said abrading step is conducted with roller means maintained in contact with said photosensitive member.

8. An image forming process according to claim 7, wherein said roller means is sponge roller means.

9. An image forming process according to claim 5, wherein said charge generation layer contains the particles of said fluorine-containing resin in an amount of 0.1 to 40% by weight.

10. An image forming process according to claim 5, wherein said charge generation layer contains the particles of said fluorine-containing resin in an amount of 5 to 25% by weight.

11. An image forming process according to claim 5, wherein the particle size of said pigment is in a range from 0.03 to 0.5μ.

* * * * *